US005450803A

United States Patent [19]

Svensk et al.

[11] Patent Number: 5,450,803

[45] Date of Patent: Sep. 19, 1995

[54] METHOD FOR THE COMBUSTION OF WASTE LIQUIDS

[75] Inventors: Lennart Svensk, Delsbo, Sweden; Winston Trusler; Salmon J. Van Rensburg, both of Mandini, South Africa

[73] Assignee: Gotaverken Energy AB, Sweden

[21] Appl. No.: 204,192

[22] PCT Filed: May 24, 1994

[86] PCT No.: PCT/SE92/00384

§ 371 Date: Apr. 18, 1994

§ 102(e) Date: Apr. 18, 1994

[87] PCT Pub. No.: WO93/05228

PCT Pub. Date: Mar. 18, 1993

[30] Foreign Application Priority Data

Sep. 5, 1991 [SE] Sweden ..... 9102546

[51] Int. Cl.[6] ..... F23G 7/04

[52] U.S. Cl. ..... 110/346; 110/238; 110/297; 122/7 C

[58] Field of Search ..... 110/238, 346, 297; 122/7 C; 431/173

[56] References Cited

U.S. PATENT DOCUMENTS 2,911,284 11/1959 Hochmuth .
3,703,919 11/1972 Owens et al. ..... 122/7 C X
5,007,354 4/1991 Uppstu ..... 110/238
5,022,331 6/1991 Simonex ..... 122/7 C X

*Primary Examiner*—Denise L. Gromada
*Attorney, Agent, or Firm*—Lerner, David, Littenberg, Krumholz & Mentlik

[57] ABSTRACT

The present invention relates to a method for the combustion of waste liquids in connection with recovering of chemicals from the waste liquid, preferably black liquor from pulp production whereby the liquid (5A) is injected at a given level (4) into a furnace (1, 2, 3) in which the liquid (5A) initially is dried and the solid remainder thereafter is pyrolysed and finally burned and the chemicals are assembled on the bottom of the furnace while the exhaust gases (8) are going up through and out from the furnace (1, 2, 3) and whereby a part of the combustion air, so called primary air (11), is supplied at one or more levels (6) below said level (4) of liquid injection (5A) and another part of the combustion air, so called secondary air (12), is supplied at one or more levels (7) between said levels for liquid injection (4) and primary air supply (6) respectively, whereby the secondary air (12) is supplied to the furnace (1, 2, 3) in such a way that the gas is forced to rotate in a plane substantially perpendicular to the longitudinal axis (13) of the furnace so that the in the furnace injected liquid (5A) is thrown outwardly against the walls of the furnace (2) by the gas rotation during simultaneous drying and pyrolysing whereby also the so called "chimney effect" in the furnace is counter-acted.

5 Claims, 2 Drawing Sheets

METHOD FOR THE COMBUSTION OF WASTE LIQUIDS

TECHNICAL FIELD

Figure 1:
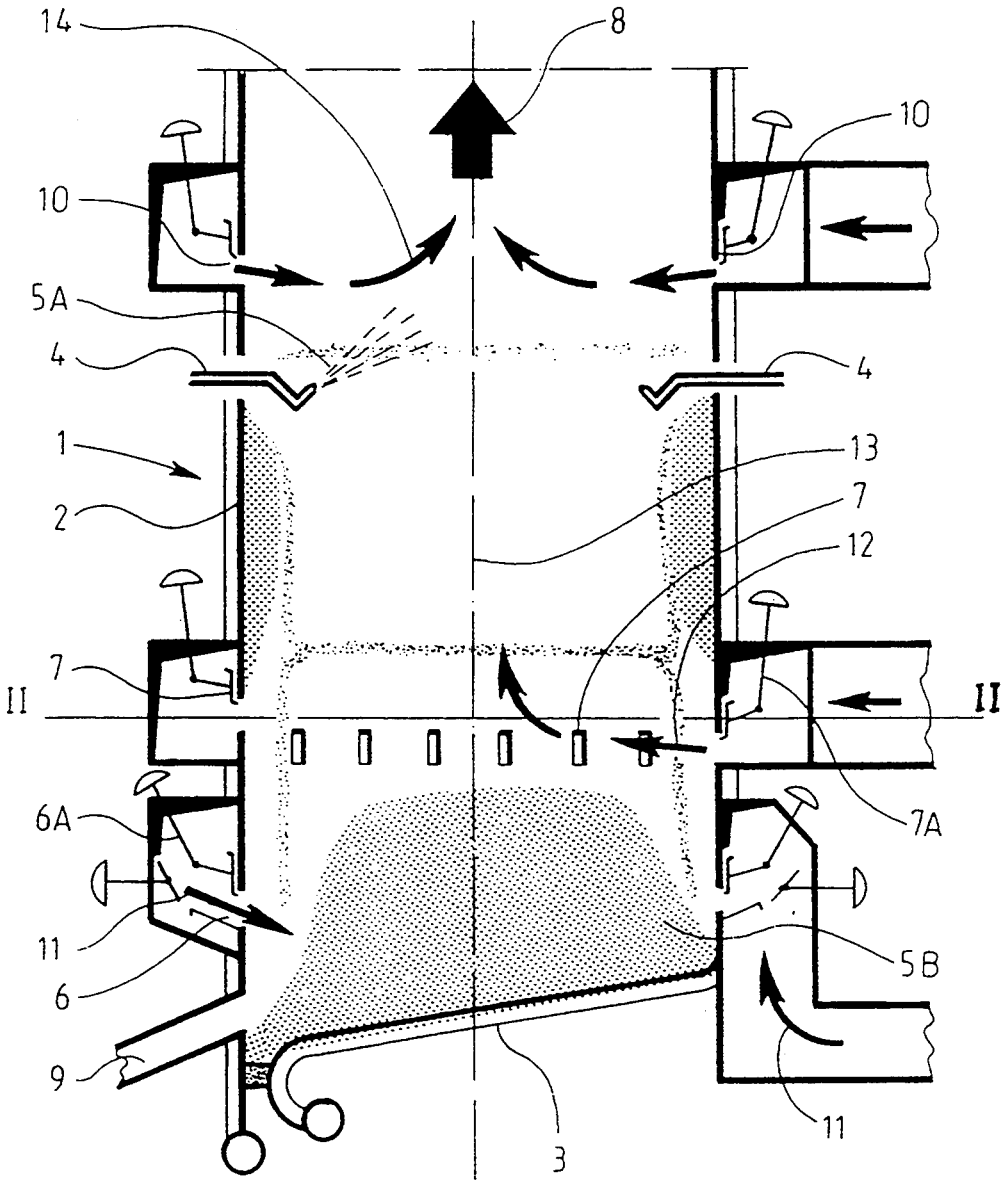

The invention relates to a method for the combustion of waste liquids in connection with recovering of chemicals from waste liquid preferably black liquor from pulp production for recovering of chemicals and energy. Most often the combustion is in the latter case carried out in a specially designed boiler which is called a soda furnace. The invention is related to the way of supplying combustion air into such a boiler.

PRIOR ART

With the aim to better clarify the invention below it is only referred to combustion of waste liquids from pulp production which, however, shall not be regarded as limiting the invention. By the production of chemical cellulose pulp from wood or other cellulose containing raw materials a rest product in the shape of spent liquor is obtained which after evaporation for reducing the water content suitably is burnt for recovering of the chemicals used at the pulp production and to transfer the organic compounds in the spent liquor to useful energy.

Most often the chemicals used at the pulp production consist of sodium salts and in these cases the main cation content of the waste liquor consists of sodium. When after evaporation sodium containing waste liquor is burnt, the main part of the inorganic substances are liberated in the form of ash in melt form which primarily consists of sodium carbonate, so called soda ($Na_2CO_3$).

The evaporated waste liquor which still contains some water is added to the soda furnace at some level above the bottom of the furnace usually by means of one or more injection nozzles. The accordingly finely distributed waste liquor is in the soda furnace subjected to three stages which can be called the drying stage, the pyrolysing stage and the carbon combustion stage. The last stage occurs primarily in the melt bed (char bed), which is made up of the residue from the pyrolysing on the bottom of the soda furnace. This bed with a high content of carbon is a condition that the main part of the content of sulphur in the ash shall be tapped in reduced form together with the melt, that is as sulphide ($Na_2S$). To have the reduction reaction carried out and to tap the ash in melt form it is required that the temperature of the melt bed shall be kept above a certain level. This is possible due to the fact that the combustion of carbon is an exotherm reaction, i.e. energy in the form of heat is developed by the reaction. This is kept alive by the addition of combustion air through the walls of the soda furnace at a low level. Combustion air which is supplied at the lowermost level in a soda furnace is usually called primary air.

Both drying and pyrolysing are endotherm processes, i.e. energy has to be supplied from the environment. If a too large part of these processes should occur at the melting bed the temperature of the bed would sink under the required level and all reactions should cease (so called black bed). Due to this reason one has to make sure that the main part of the drying and pyrolysing stages have been fulfilled when the solid material reaches the melting bed on the bottom of the soda furnace.

Two principally different methods to bring about the necessary drying and pyrolysing is today practised industrially. The one is to let the injected waste liquor droplets after some initial drying hit some of the walls of the soda furnace. The waste liquor will then due to convective heat supply from the walls of the furnace, radiation from the melt bed and radiation from the above the bed burning pyrolysing gas initially be dried to a finishing stage and then the pyrolysing stage starts. In connection with the pyrolysing a swelling of the material occurs which then is liberated and falls down on the melt bed.

The second method is that by finely distributing of the injected waste liquor and/or violent gas turbulence in the fire make sure that a sufficiently great part of the drying and pyrolysing reactions occur when the waste liquor still is suspended in the furnace gases and before the waste liquor particles reach the melt bed.

None of the above described methods could possibly be adapted to a soda furnace where the waste liquor is supplied through injection nozzles directed into the fire. Even if one tries to direct the liquor distributors so that the liquor can hit the walls a part of the drops will never reach the walls and will be dried and pyrolysed in a suspended form. On the other side it should be inevitable that also finely distributed droplets of the liquor which is supplied with the aim to bring about said reactions in suspension to some extent will reach the walls of the furnace and adhere there. One can, however, in different ways design and operate a soda furnace so that one or the other method dominates.

The present invention relates to the first mentioned method, i.e. the addition occurs so that a larger part of the liquor adheres on the furnace walls before the drying and pyrolysing reactions are finished in principle according to the so called Tomlinson process (SE-B-84138). At this process the waste liquor is injected by an oscillating distributor in such a way that the walls of the furnace are "painted" up to a level a few meters above the level of the primary air. Between this and the level of the waste liquor supply so called secondary air is supplied the main object of which is to bring about burning of the pyrolysing gasses above the melting bed. Heat which is developed by this combustion of gas is partly transferred by radiation to the liquor which has been supplied to the furnace.

Usually a further part of the combustion air is supplied to the furnace at a level above the injection level of the waste liquor, so called tertiary air. By means of this a final combustion of the gases are made so that the content of unburned gas in the shape of carbon monoxide (CO), hydrogen sulphide ($H_2S$), etc in the effluent gas is maintained on a safe low level.

THE PROBLEM

As soda furnaces of capacity reasons have grown in size it has been more difficult to maintain a genuine Tomlinson process. The distance between the waste liquor injection points and the walls of the furnace which shall be painted have been so large that a great part of the liquor never reaches them. One has therefore when it is a question of larger soda furnaces been forced to let an appreciable part of the injected liquor dry and be pyrolysed suspended in the gases.

If a greater part of the drying and pyrolysing occurs in suspension the risk that also carbon combustion will occur in the suspension is increased and therethrough the amount of inorganic material which follows the exhaust gases from the furnace will increase. This can in its turn give rise to increased coverings on the heat surfaces in the upper part of the soda furnace resulting in decreased efficiency and availability.

An other disadvantage due to carbon combustion in the suspension is that the rest melt from a preburnt waste particle also if it does not follow the effluent gases, but falls down to the bottom of the furnace more easily can be oxidized and accordingly will not contain sulphur in reduced form.

SOLUTION AND ADVANTAGES

The object of the present invention is to bring about a method by which the above said disadvantages are reduced or eliminated.

Said objects can be attained by a method for combustion of waste liquids in connection with recovering of chemicals from the waste liquor, preferably waste liquor from pulp production whereby the liquid is injected at a given level in a furnace in which the liquid is initially dried and the rest thereafter is pyrolysed and finally burnt and the chemicals are assembled on the bottom of the furnace whereas the exhaust gases are going up through and out of the furnace and whereby a part of the combustion air, the so called primary air, is supplied at one or more levels below said level for the injection of the liquid and another part of the combustion air, the secondary air is supplied at one or more levels between said levels for the injection of the liquor and the supply of the primary air respectively, characterized in that the secondary air is supplied to the furnace in such a way that the gas is forced to rotate in a plane substantially perpendicular to the vertical axis of the furnace so that the in the furnace injected liquid is by the gas rotation thrown out against the walls of the furnace during simultaneous drying and pyrolysing.

By means of the invention the part of the liquid which adheres on the walls of the furnace is increased also in very large soda furnaces and the above said disadvantages relating to coverings on the heat surfaces is decreased or even completely avoided. Further one gains the advantage that a very high part of the sulphur is recovered in reduced form. This results in that the efficiency of the plant will rise and the influence on the environment in form of sulphur emissions will decrease.

The rotation obtained thus also has the advantage that the so called "chimney effect" which is specially notisable at large soda furnaces is counter acted. The "chimney effect" depends on that the gases in the center of the furnace due to longer distance from the normally water cooled walls of the furnace have a higher temperature than the peripheral gases and consequently lower density. The gas tends therefore to move upwardly at a greater velocity in the center than at the walls. In some cases it can go so far that the stream is downwardly directed at the walls of the furnace. The effect can be increased if combustion air is added in a conventional way, that is evenly at the same level through the four walls of the furnace, due to the fact that the air beams meet in the center and therethrough get an upwardly directed action.

According to a preferred embodiment of the invention the above method is complemented in that all combustion air which is supplied above the waste liquor distribution level (so called tertiary air) shall be so directed that the on a lower level started rotation is broken or reduced so that one in the longitudinal plane of the soda furnace substantially symmetrical streaming pattern is obtained.

To create rotation in the gas in a furnace by the supply of air is known per se, but relates in relation to the invention to different purposes. By for instance SE-B-197065 a method for the combustion of waste liquors is known whereby the secondary air is supplied so that the gas is forced to rotate in the horizontal plane. The known method does however relate to the supply of secondary air above the level in which the waste liquor is added. The object for this known process is also different, namely that in this way to try to increase possible total air supply to optimate the combustion itself and to separate by means of the centrifugal force solid particles which follow the exhaust gases. Also in connection with combustion of chips it is known to create rotation in the burning gases, see for instance U.S. Pat. No. 2,483,728 in which such a method is described where two counteracting gas whirls are used to obtain a more effective drying of the chips.

SHORT DESCRIPTION OF THE FIGURES

Figure 2:
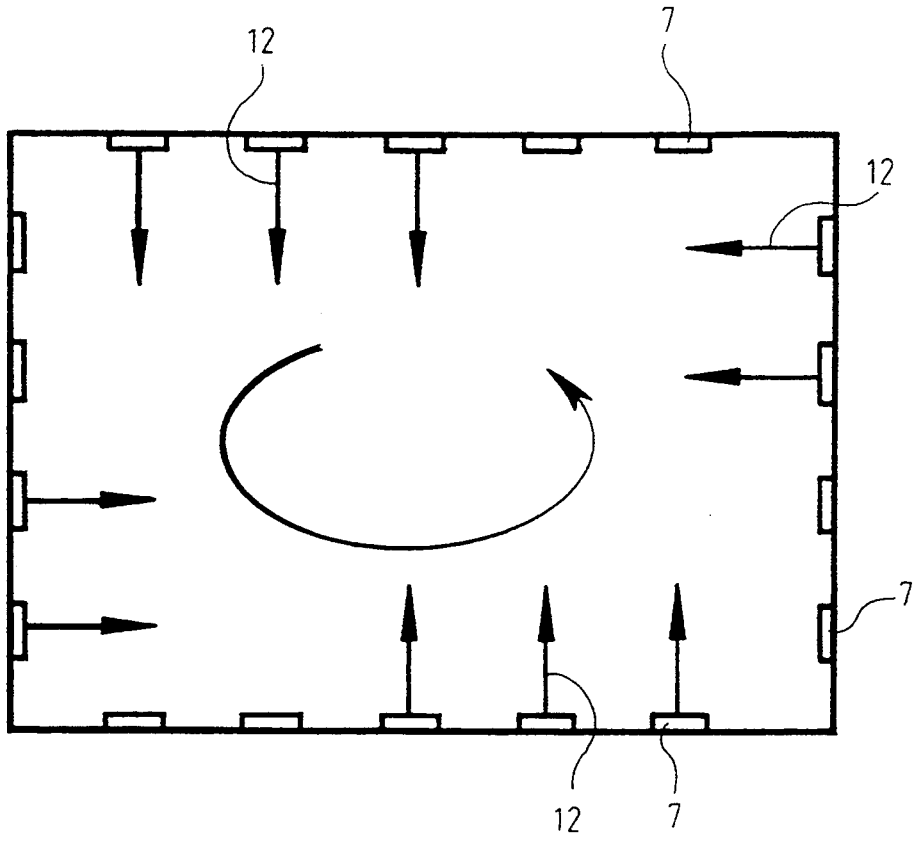

In the following the invention will be explained more in detail in connection with the attached drawings in which:

FIG. 1 is a schematic view of the lower part of a soda furnace in section in the verticle plane, and FIG. 2 shows a section through the furnace in FIG. 1 along a horizontal plane which is marked with II.

In FIG. 1 is schematically shown the lower part of a soda furnace 1 comprising walls 2 and a bottom 3. Through nozzles 4 liquid waste 5A is injected. Within the soda furnace a temperature of about 1000° C. prevails.

Primary air 11 is supplied to the furnace through a battery of nozzles 6, which can be found at a lower level. The airflow through these can be controlled by valves 6A.

Secondary air 12 is supplied by means of nozzles 7 provided with valves 7A at a level between the nozzles 4 for the injection of waste liquor and the nozzles 6 for the primary air.

The organic material in the waste liquor will be burned and move upwardly out of the furnace as exhaust gases 8. The inorganic material 5 will contrary thereto in melt form be found in a melt bed 5B on the bottom 3 of the furnace 1. This melt which contains recovering worthy chemicals can be tapped through an outlet 9.

The secondary air 12 is supplied to the furnace 1 via a number of nozzles 7 which have been arranged symmetrically in the walls of the in section square furnace (see FIG. 2). The in the embodiment example shown secondary air supply can occur through five nozzles from each longside and four nozzles respectively from each shortside. By varying the openings of these nozzles (by means of the valves 7A the air supply can practically be controlled down to zero) according to a certain pattern one can create a rotation of the gas in a plane which is perpendicular to the longitudinal axis 13 of the furnace. In the example shown this is created therethrough that at each side the valves 7A are closed in two neighbouring nozzles 7 located closest to a corner, which nozzles 7 are arranged in pairs substantially diametrically in relation to the vertical longitudinal axis 13. The rotation can be optimized/accurately adjusted by individually controlling the flow from each open nozzle 7 by means of the valves 7A.

To change the direction of the rotation of the gas stream one can mirror change the pattern for the opening degree of the nozzles. Such a change can be advantageous to obtain an even possible wearing of parts present.

Above the liquor injection nozzles 4 a number of tertiary air nozzles 10 are arranged. According to a preferred embodiment these nozzles 10 are arranged in such a way that the supply of tertiary air effectively counteracts/breaks the rotation of the gas brought about by the secondary air stream 12 so that in the ideal case a symmetrical rising gas stream is obtained in the longitudinal plane of the soda furnace.

In an application example of the present invention of a big soda furnace 1 primary air 11 is supplied about 1 meter above the bottom 3 and the furnace at low pressure through the four walls 2 of the soda furnace approximately evenly. Secondary air 12 is supplied at a level about 2 meter above the primary air 11 at a higher pressure and through openings 7 arranged and used in principal as shown in the figures. Evaporated waste liquor 5 from pulp production is injected through some liquor spraying nozzles 4 which are arranged at a level of about 4 meter above the secondary air supply 12 and at an inlet pressure of about 1 bar. Tertiary air 14 is finally supplied at a still higher pressure than the secondary air 12 through openings 10 which also are evenly distributed over the front and rear walls of the soda furnace at a level further about 4 meters upwards.

The invention is not limited to the above shown, but can be varied within the scope of the following claims. Thus the secondary air can be supplied at several different levels as one can imagine future presence of further air supply above the tertiary level. It is further evident that other changes such as for example the shape of the soda furnace (for example round instead of square) lies within the frame of what is comprised of the patent protection. It is also obvious that one instead of evenly great and evenly located air ports 7 and 10 and 6 respectively as shown in the figures, one can use ports at every level of varying size and varying location. It is also obvious that the number of air nozzles can be varied within wide frames whereby one extreme means that every wall in principal only is arranged with one single air nozzle at one and the same level.

We claim:

1. Method for the combustion of waste liquids in connection with recovering of chemicals from the waste liquid from pulp production comprising the steps of: injecting said waste liquid at a given level in a furnace in which said liquid initially is dried resulting in a solid remainder and wherein the solid remainder thereafter is pyrolysed and finally burned and the chemicals are assembled on the bottom of the furnace while the exhausts gases go up through and out of the furnace and whereby primary combustion air is supplied at one or more levels below said level for the injection of said waste liquid and secondary combustion air is supplied at one or more levels between said levels of the injection of solid waste liquid and primary combustion air respectively, and where the secondary combustion air is supplied to the furnace in such a way that said exhaust gas is forced to rotate in a plain substantially perpendicular to the longitudinal axis of the furnace so that in the furnace said injected waste liquid is thrown outwardly towards the walls of said furnace by the gas rotation during simultaneous drying and pyrolysing such that the "chimney effect" in the furnace is counteractive.

2. Method according to claim 1, further comprising injecting tertiary combustion air for combustion, at a given location at a level above the level for the injection of the waste liquid and in such a way that below the level that said tertiary combustion air is introduced, gas rotation is reduced or eliminated.

3. Method according to claim i wherein the secondary combustion air periodically is supplied through at least one nozzle in a way that gives a first rotation direction, and periodically in a different direction so as to minimize possible wearing of said combustion air nozzles.

4. Method according to claim 1, wherein said secondary air is supplied through at least one nozzle and wherein at least 70% of the total air which is supplied through said secondary combustion air nozzles is supplied in such a way that it gives a positive contribution to create said rotation of the gas.

5. The method according to claim 1, wherein said secondary air is supplied through at least one nozzle and wherein at least 90% of the total air which is supplied through said secondary combustion air nozzle is supplied in such a way that it gives a positive contribution to create said rotation of the gas.

* * * * *

UNITED STATES PATENT AND TRADEMARK OFFICE

CERTIFICATE OF CORRECTION

PATENT NO. : 5,450,803

DATED : September 19, 1995

INVENTOR(S) : Svensk et al.

It is certified that error appears in the above-identified patent and that said Letters Patent is hereby corrected as shown below:

Column 6, line 29, "i" should read --1--.

Signed and Sealed this

Thirtieth Day of January, 1996

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,450,803

DATED : September 19, 1995

INVENTOR(S) : Svensk et al.

It is certified that error appears in the above-identified patent and that said Letters Patent is hereby corrected as shown below:

On cover page, in item 22 "May 24, 1994" should read --June 4, 1992--.

Signed and Sealed this

Twenty-seventh Day of February, 1996

*Attest:*

Bruce Lehman

BRUCE LEHMAN

*Attesting Officer*

*Commissioner of Patents and Trademarks*